US012729603B2

(12) United States Patent
Moyes et al.

(10) Patent No.: US 12,729,603 B2
(45) Date of Patent: Sep. 8, 2026

(54) HYDRAULIC LOCK APPARATUS

(71) Applicant: Welleng Science and Technology Ltd, Banchory (GB)

(72) Inventors: Peter Barnes Moyes, Aberdeenshire (GB); Stefan Neil Lewis Stewart, Aberdeenshire (GB)

(73) Assignee: Welleng Science and Technology Ltd, Banchory (GB)

( * ) Notice: Subject to any disclaimer, the term of this patent is extended or adjusted under 35 U.S.C. 154(b) by 356 days.

(21) Appl. No.: 18/251,465

(22) PCT Filed: Oct. 26, 2021

(86) PCT No.: PCT/EP2021/079740
§ 371 (c)(1),
(2) Date: May 2, 2023

(87) PCT Pub. No.: WO2022/096327
PCT Pub. Date: May 12, 2022

(65) Prior Publication Data

US 2023/0407720 A1 Dec. 21, 2023

(30) Foreign Application Priority Data

Nov. 4, 2020 (GB) ..... 2017435

(51) Int. Cl.
*E21B 34/10* (2006.01)
*E21B 23/04* (2006.01)

(52) U.S. Cl.
CPC ..... *E21B 34/102* (2013.01); *E21B 23/0413* (2020.05); *E21B 23/042* (2020.05)

(58) Field of Classification Search
CPC ... E21B 34/102; E21B 23/0413; E21B 23/042
See application file for complete search history.

(56) References Cited

U.S. PATENT DOCUMENTS 4,580,632 A 4/1986 Reardon
2013/0118758 A1 5/2013 Caminari
(Continued)

FOREIGN PATENT DOCUMENTS

WO 2015109407 A1 7/2015
WO WO-2017204657 A1 11/2017

OTHER PUBLICATIONS

International Preliminary Report on Patentability for PCT/EP2021/079740 dated May 19, 2023.
(Continued)

*Primary Examiner* — Neel Girish Patel
(74) *Attorney, Agent, or Firm* — Harness, Dickey & Pierce, P.L.C.

(57) ABSTRACT

A hydraulic lock apparatus includes a fluid release valve including a valve port and a valve member axially moveable within a valve chamber, wherein the fluid release valve is moveable from a sealing arrangement to an open arrangement, wherein the fluid release valve defines a second seal area when in the sealing arrangement; and a hydraulic chamber defined between a first seal area of a lock operator piston and the second seal area of the fluid release valve; wherein the first seal area is larger than the second seal area; and the fluid release valve is configured to be moveable from the sealing arrangement, in which the hydraulic chamber is isolated from the valve port, to the open arrangement, in which the hydraulic chamber is connected to the valve port, in response to a differential pressure cycle being applied to the valve member over the second seal area.

19 Claims, 14 Drawing Sheets

(56) References Cited

U.S. PATENT DOCUMENTS

| | | | | |
|---|---|---|---|---|
| 2013/0269928 | A1* | 10/2013 | Zhou | E21B 17/06 166/113 |
| 2015/0337624 | A1* | 11/2015 | Themig | E21B 34/063 166/317 |
| 2017/0275968 | A1* | 9/2017 | Purkis | E21B 34/103 |
| 2021/0156235 | A1* | 5/2021 | Yin | E21B 33/12 |

OTHER PUBLICATIONS

International Search Report for International Application No. PCT/EP2021/079740 dated Jan. 14, 2022.
Search Report for Intellectual Property Office Application No. GB 2017435.5 dated Jul. 2, 2021.
Written Opinion for International Application No. PCT/EP2021/079740 dated Jan. 14, 2022.

* cited by examiner

HYDRAULIC LOCK APPARATUS

CROSS-REFERENCE TO RELATED APPLICATIONS

This application is a national phase under 35 U.S.C. § 371 of PCT International Application No. PCT/EP2021/079740 which has an International filing date of Oct. 26, 2021, which claims priority to United Kingdom Application No. GB 2017435.5, filed Nov. 4, 2020, the entire contents of each of which are hereby incorporated by reference.

FIELD

The present disclosure relates to a hydraulic lock apparatus.

BACKGROUND

Many devices employ hydraulic locks in order to lock an actuator, such as a piston, and prevent unintentional or inadvertent actuation of the device. Hydraulic locks may typically be employed during the installation of a device, or during periods when the device is to remain inactive.

Such locks may utilise a fluid in a sealed chamber adjacent the actuator to lock the actuator in place. In order to free the actuator and allow actuation of the device, the hydraulic lock must be disengaged, for example by unsealing the chamber to release the fluid therein.

Hydraulic locks are often used downhole in the oil and gas field. The environments in which such hydraulic locks are used are therefore often challenging. In some devices, the process of unsealing the chamber and thus releasing the actuator is a time consuming and complicated process, which is prone to failure in hostile environments. The process of unsealing the chamber may also require significant movement within the device which can result in undesirable damage or wear of key device components, such as seals. Naturally it is desirable for the process of unlocking a hydraulic lock to be as robust as possible, with minimal risk of damage or wear to device components.

SUMMARY

According to the disclosure is a hydraulic lock apparatus. The hydraulic lock may comprise:

- a lock operator piston, which may be arranged to be axially moveable in a piston chamber. The lock operator piston may define a first seal area.

The hydraulic lock may further comprise a fluid release valve, which in turn may comprise a valve port and a valve member which may be axially moveable within a valve chamber. The fluid release valve may be moveable from a sealing arrangement to an open arrangement. The fluid release valve may define a second seal area when in the sealing arrangement.

The hydraulic lock may further comprise a hydraulic chamber. The hydraulic chamber may be defined between the first seal area of the lock operator piston and the second seal area of the fluid release valve.

The first seal area may be larger than the second seal area.

The fluid release valve may be configured to be moveable from the sealing arrangement, in which the hydraulic chamber is isolated from the valve port, to the open arrangement, in which the hydraulic chamber is connected to the valve port, for example in response to a differential pressure cycle being applied to the valve member over the second seal area.

The hydraulic lock of the disclosure may be for use in any hydraulic machine, or any machine with moving components which may need, at times, to be prevented from moving.

The hydraulic lock may be for use in a fluid control valve. The hydraulic lock may be for use in the oil and gas field. For example, the hydraulic lock may be for use in a downhole tool or tubular. The hydraulic lock may be for use in a completion string, for example as part of a flow control sub.

The hydraulic lock of the disclosure can be moved from a locked configuration (e.g. when the fluid release valve is in a sealing arrangement) to an unlock configuration (e.g. when the fluid release valve is in an open arrangement) with minimal movement of the lock operator piston. This is largely due to the relative sealing areas provided by the lock operator piston and the fluid release valve.

In certain downhole environments, the movement of pistons can result in undesirable wear or damage from debris—for example to the piston seals. By providing a hydraulic lock which can be unlocked with minimal movement of the lock operator piston, the hydraulic lock can be unlocked with minimal risk of wear, degradation or damage to the lock operator piston.

The lock operator piston may comprise a piston assembly. The lock operator piston may comprise a piston body and two piston seals.

The piston chamber may be annular. The lock operator piston may be an annular piston. The piston chamber may be arranged in the housing of a tubular, or between a housing of the tubular and a co-axial sleeve member, which form an annular gap therebetween. The piston chamber, housing, or gap between the housing and a co-axial sleeve member may also form part of the hydraulic chamber discussed below.

The first seal area may be the effective area over which fluid pressure can act to urge the lock operator piston towards the hydraulic chamber.

The lock operator piston may be arranged such that one side of the lock operator piston is exposed to a first pressure. The first pressure may be an operating pressure. The first pressure may be a tool, tubular, environmental or external (e.g. annulus) pressure. The operator piston may also be arranged such that the other side of the lock operator piston is exposed to the pressure in the hydraulic chamber. When the hydraulic lock is in a locked configuration, the hydraulic chamber may be isolated, thus locking the lock operator piston in place (with the exception of minimal movement permitted by the fluid release valve, as discussed below). When the hydraulic lock is in an unlocked configuration, the hydraulic chamber may be pressure or fluidically connected to a second pressure. The second pressure may be an operating pressure. The second pressure may be a tool, tubular, environmental or external (e.g. annulus). The lock operator piston may thus be urged axially due to a differential pressure acting across it.

The lock operator piston may define:

- a first pressure surface corresponding to the first seal area which is arrangeable to be exposed to an operating pressure; and/or
- a second pressure surface which is arrangeable to be exposed to the hydraulic chamber.

The second pressure surface may comprise a protrusion. The second pressure surface may define a tip, or a nose. The protrusion (or tip/nose) may define an end surface with a smaller surface area than the first seal area.

The fluid release valve may be configured to selectively move from a sealing arrangement to an open arrangement.

With the fluid release valve in the sealing arrangement, the hydraulic lock may be in a locked configuration and axial movement of the lock operator piston may be restrained. With the fluid release valve in the open arrangement, the hydraulic lock may be in an open arrangement and the lock operator piston may be free to move.

The other fluid release valve components may be housed within the valve chamber. The valve chamber may be cylindrical. The valve chamber may be a bore. The valve chamber may be axially aligned. The valve chamber may be an axially-aligned bore in the housing, or an annular-sleeve, of a downhole tubular.

The cross-sectional area of the valve chamber may be smaller than that of the lock operator piston. The cross-sectional area of the valve chamber may be significantly smaller than that of the lock operator piston.

The valve port may be arranged to allow fluid to pass therethrough. The valve port may be arranged to vent fluid from the fluid release valve. The valve port may comprise a valve. The valve port may be arranged to connect the valve chamber to the environment or annulus (e.g. of a bore hole and downhole tubular). The valve port may be fluidically connected to one side of the lock operator piston when the fluid release valve is in an open arrangement.

The valve member may be arranged in the valve chamber. The valve member may comprise a rod, e.g. a valve member rod. The valve member may comprise a ratchet module. The valve member may be arranged to be axially moveable within the valve chamber, for example in response to a differential pressure acting across the fluid release valve/valve member/second seal area.

The valve member may be configured to actuate the fluid release valve between a sealing arrangement and an open arrangement. For example, the valve member may actuate the fluid release valve from the sealing arrangement to the open arrangement in response to a fluid differential pressure cycle acting across it.

The fluid release valve may comprise a key. The key may be configured to hold the fluid release valve in the sealing arrangement. The key may be configured to cooperate with the valve member to hold the fluid release valve in the sealing arrangement.

The fluid release valve may comprise a plurality of keys. The plurality of keys may be arranged circumferentially around the fluid release valve. It is to be understood that where description is provided herein in relation to "a key" or "the key", this is to be understood to apply equally to "one of", "some of" and "each of" a plurality of keys.

The key may be configured to move from a blocking position, in which the fluid release valve is held in the sealing arrangement, to a free position, in which the fluid release valve is free to move to the open arrangement.

The key may be biased towards the free position.

The key may comprise a camming surface to urge the key in a radial direction through interaction with an adjacent component.

The valve member may be configured to move from a first position, in which the key is held in the blocking position, to a second position, in which the key is free to move to the free position, under the action of a pressure differential across the valve member.

The action of a pressure differential across the valve member may be cyclic.

The valve member, or valve member rod, may comprise a change in diameter part way along its length. The change of diameter may correspond to a shoulder, neck or head portion. The fluid release valve may be arranged such that the key is adjacent the change in diameter when the key is in the blocking position and/or the free position.

The valve member may comprise a blocking member. The blocking member may be arrangeable adjacent the key for holding the key in the blocking position.

The fluid release valve may comprise a ratchet module. The ratchet module may be configured to incrementally move from a first position, in which it holds the key in the blocking position, to a second position, in which the key is free to move to the free position, in response to a cyclic pressure differential acting across the valve member.

The ratchet module may comprise a first and second ratchet. The first ratchet may be configured to restrain movement of the ratchet module relative to a rod of the valve member. The second ratchet may be configured to restrain movement of the ratchet module relative to the key.

The ratchet module may comprise the blocking member. The ratchet member may be configured to move the blocking member from a blocking position to non-blocking position with respect to the key.

The fluid release valve may comprise a carriage assembly. The carriage assembly may be arranged to be axially moveable within the valve chamber. The carriage assembly may be moveable from a first to a second position to move the fluid release valve from the sealing to the opening arrangement.

The carriage assembly may comprise the key. The carriage assembly may comprise a seal assembly.

The fluid release valve may comprise a shear ring, or other frangible fastener. The shear ring or other frangible fastener may be arranged to restrain the carriage assembly in the first position, thus maintaining the fluid release valve in the sealing arrangement. The fluid release valve may be configured such that the carriage assembly breaks the ring or fastener when the pressure differential acting on the second seal area reaches a threshold value, thus allowing the carriage assembly to move to the second position and the fluid release valve to move to the open arrangement.

The fluid release valve may comprise a spring. The spring may be operatively arranged between the valve member (e.g. valve member rod) and the carriage assembly.

The fluid release valve may comprise a seal assembly. The seal assembly may be fixed with respect to the carriage assembly. The seal assembly may be arranged to prevent fluid flow through the fluid release valve when the fluid release valve is in the sealing arrangement. The sealing assembly may be arranged to seal between the valve chamber and the carriage assembly, and the carriage assembly and the valve member.

The seal assembly may define the second seal area.

The second seal area may be substantially smaller than the first seal area. The second seal area may substantially equal to or less than 10%, 5%, 2%, 1%, 0.5% of the first seal area.

When the second seal area is smaller than the first seal area, axial movement of the first seal area (e.g. the lock operator piston) results in a far greater axial movement of the second seal area (e.g. the seal assembly, carriage assembly or valve member). As such, the movement necessary for moving the fluid release valve from the sealing arrangement to the open arrangement can be achieved with very little movement (and thus wear/risk of damage) to the lock operator piston.

As an example, if the first seal area is 5 $in^2$ (3225.8 $mm^2$) and the second seal area is 0.02 $in^2$ (12.9 $mm^2$), a 3 mm travel of the second seal area (e.g. of the carriage assembly)—which is a reasonable estimate of such a movement being required to unseal a fluid release valve—can be achieved with only a 0.012 mm travel of the lock operator piston.

The fluid release valve may be provided as a cartridge. All, or some of, the components of the fluid release valve described herein may be provided as a cartridge or a cartridge assembly. The cartridge may be configured to be inserted into a bore in a tubular or downhole tool.

The hydraulic chamber may be defined within the housing of a tubular. The hydraulic chamber may be arranged between a housing of a tubular and a concentric tubular sleeve. The hydraulic chamber may be defined between the lock operator piston and the fluid release valve.

The hydraulic chamber may define a restriction. The restriction may be a restriction in cross-sectional area. The restriction may be defined by an annular shoulder or the presence of an annular sleeve located within the annular gap defining the hydraulic chamber.

The lock operator piston may be configured to engage the restriction of the hydraulic chamber. The lock operator piston may be configured to insert into the restriction of the hydraulic chamber in order to lock the lock operator piston in position.

When the lock operator piston is inserted into the hydraulic chamber restriction, fluid pressure acting on the lock operator piston from the hydraulic chamber may act on a smaller surface area than the surface on which fluid can act on the other side of the lock operator piston. As such, a far greater pressure may be required on the restriction side, e.g. from the annulus, than the other side, in order to move the lock operator piston out of the restriction. Depending on the geometry of the restriction and the lock operator piston, this may effectively lock the lock operator piston in engagement with the restrictions.

The seal area defined by the lock operator piston engaging the restriction of the hydraulic chamber may be smaller than the first seal area.

The lock operator piston may be configured to engage the restriction according to an interference fit.

The piston chamber may comprise an inlet. The inlet may define an inlet area which is smaller than the first seal area. The inlet may have a cross-sectional area which is less (e.g. significantly less) than the first seal area.

The hydraulic lock apparatus may further comprise a plug arranged to mate with the inlet. The lock operator piston may be configured to urge the plug into engagement with the inlet such that the plug mates with the inlet, sealing the inlet. The lock operator piston may be urged by a pressure acting over the seal area.

The lock operator piston may comprise the plug. The plug may protrude from an end of the piston, for example in the form of a pin or nose.

The lock operator piston may be configured to mate with the inlet.

The lock operator piston may be configured to engage the inlet. The lock operator piston may be configured to enter the inlet, for example in order to lock the lock operator piston in position.

The lock operator piston may be configured to be urged by a pressure acting over the seal area such that the plug mates with the inlet, sealing the inlet.

The lock operator piston may be configured to mate with the inlet under the action of a pressure acting over the first seal area. Given that the relative areas, this may result in an interference fit and may require a large force to dislodge the lock operator piston from the inlet.

When the lock operator piston is inserted into the inlet, fluid pressure acting on the lock operator piston from the hydraulic chamber may act on a smaller surface area than the surface on which fluid can act on the other side of the lock operator piston. As such, a far greater pressure may be required on the restriction side, e.g. from the annulus, than the other side, in order to move lock operator piston out of the restriction. Depending on the geometry of the inlet and the lock operator piston, this may effectively lock the lock operator piston in engagement with the inlet.

Further according to the disclosure is a downhole tubular comprising a hydraulic lock apparatus as described anywhere herein.

The hydraulic lock apparatus may be arranged in a tubular housing.

The lock operator piston may be an annular piston arranged in the tubular housing and the valve chamber may be an axially-aligned bore in the housing. Alternatively, the converse may be true.

The valve port may be arranged on the outer surface of the tubular housing. The valve port may be arranged to vent to the bore annulus. Alternatively, the valve port may be arranged to provide fluidic, or pressure, communication with the central bore of a bore or tubular.

The lock operator piston may be operatively connected to a tool component such that movement of the lock operator piston actuates the tool component.

The lock operator piston may be an actuator, or act as an actuator.

The lock operator piston may be a locking component for an associated or adjacent tool or tubular.

The tool component may be a mandrel.

Further according to the disclosure is downhole device comprising:

- a piston chamber comprising an inlet, the inlet defining an inlet area;
- a piston defining a seal area that is larger than the inlet area, the piston being arranged for movement within the piston chamber;
- a plug arranged to mate with the inlet;
- wherein the piston is configured to urge the plug into engagement with the inlet such that the plug mates with the inlet, sealing the inlet;
- wherein the piston is urged by a pressure acting over the seal area.

Further according to the disclosure is a wellbore completion comprising a hydraulic lock apparatus or downhole tubular as described anywhere herein.

Further according to the disclosure is a method for unlocking a hydraulic lock, the method comprising:

- axially moving a lock operator piston defining a first seal area by a first distance;
- axially moving part of a fluid release valve defining a second seal area by a second distance, thereby moving the fluid release valve from a sealing arrangement to an open arrangement;
- wherein the first distance is less than the second distance.

BRIEF DESCRIPTION OF DRAWINGS

These and other aspects of the present disclosure will now be provided, by way of example only, with reference to the accompanying Figures, in which.

DETAILED DESCRIPTION OF DRAWINGS

Figure 1:
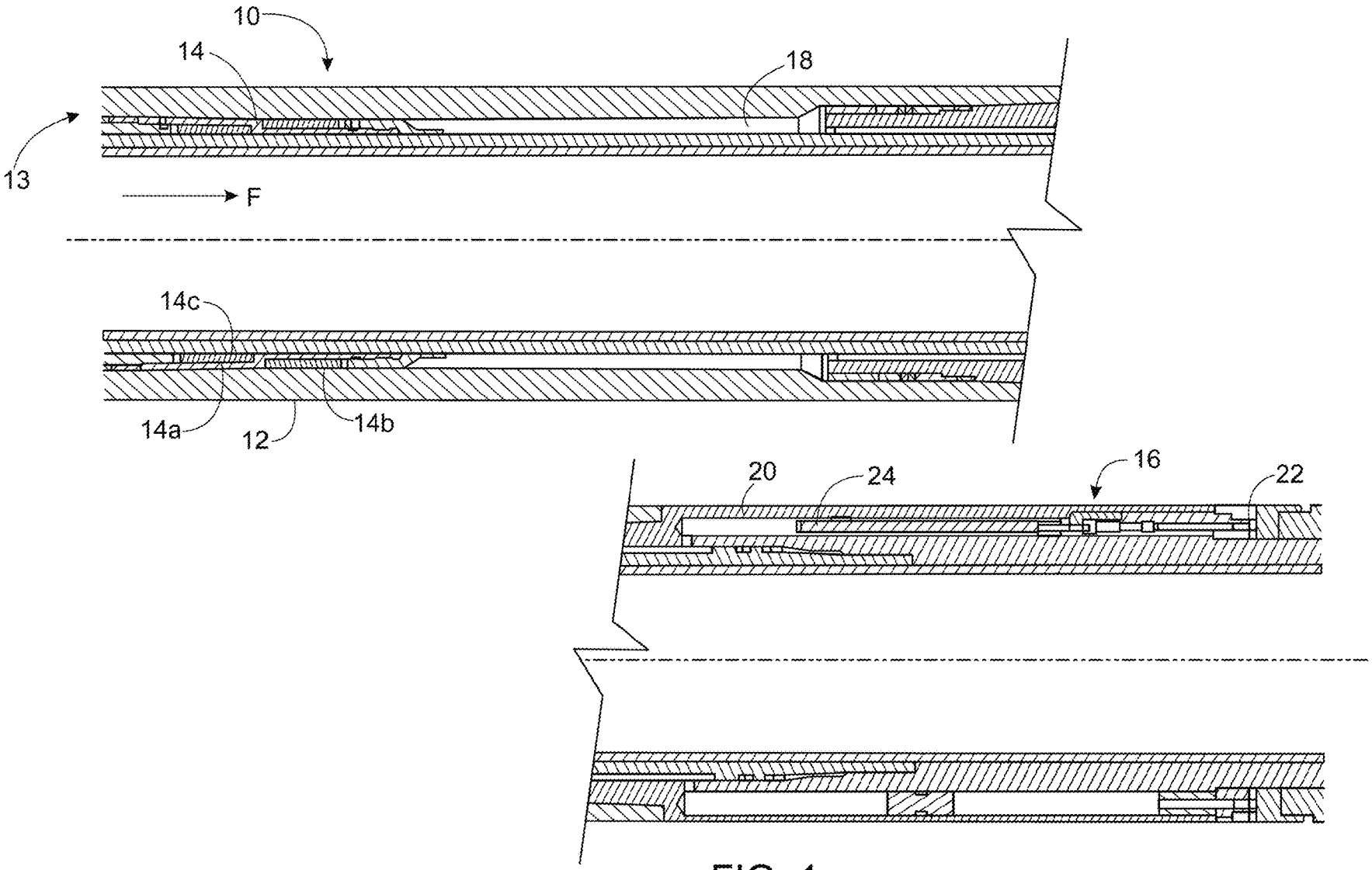
FIG. 1 is a cross-section view of a hydraulic lock according to the disclosure.

FIG. 1 shows a hydraulic lock 10 according to the disclosure in cross-section. The hydraulic lock 10 is located in the body 12 of a tubular.

The tubular is a downhole tubular for use in a wellbore. The tubular defines a central flow path along which fluid may flow during use F.

The hydraulic lock 10 comprises a lock operator piston 14, a fluid release valve 16 and a hydraulic chamber 18 located therebetween.

In the present example, the lock operator piston 14 is acted upon by tubular pressure. As such, the upper end 13 of the lock operator piston 14 is exposed to tubular pressure. In other embodiments, the upper end 13 of the lock operator piston 14 may be exposed to annulus pressure.

Figure 4:
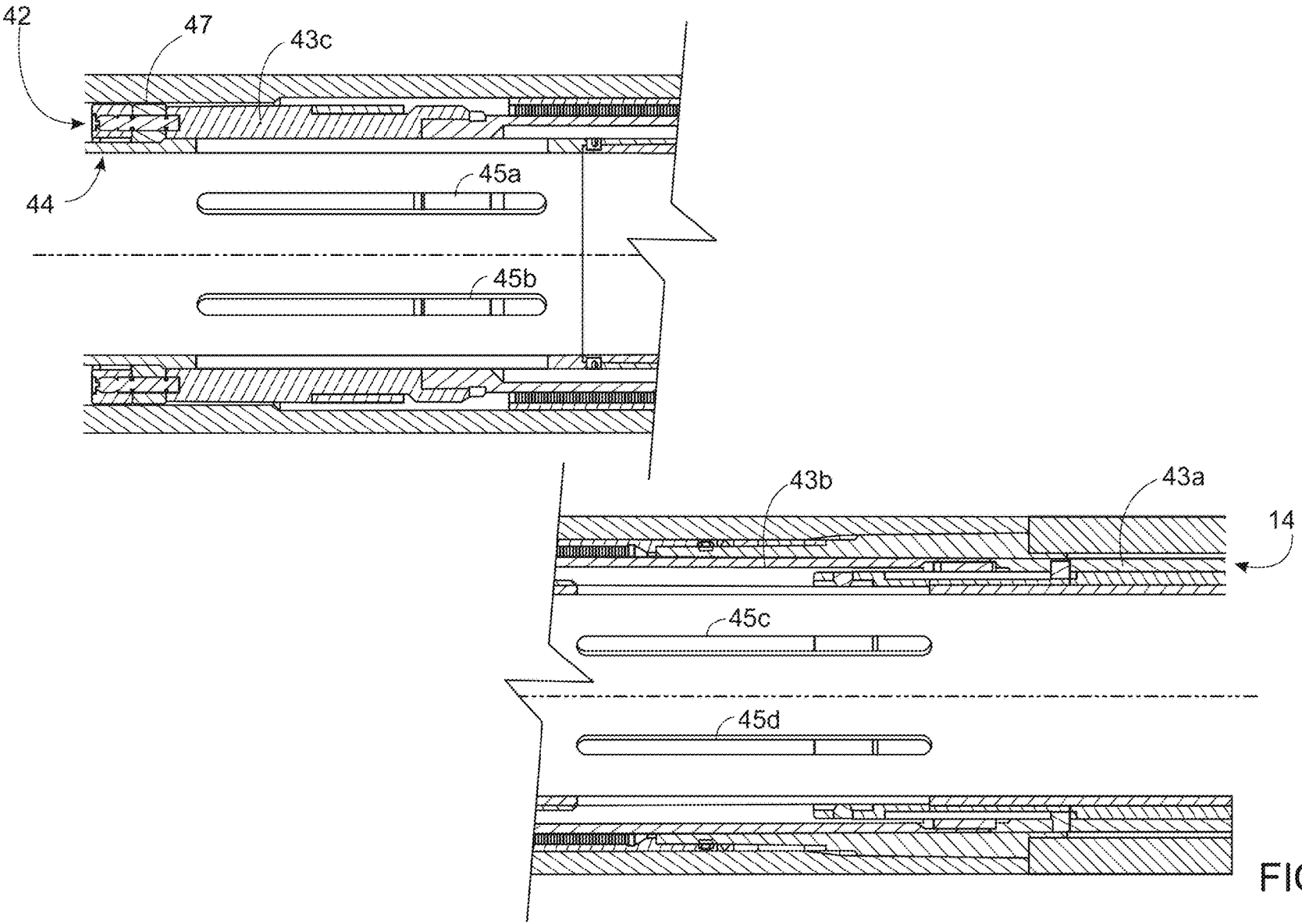
FIG. 4 is a cross-section view of part of a lock operator piston of the hydraulic lock of FIG. 1.

In this example, an internal sleeve of the tubular comprises a plurality of ports 45*a-d*) which expose the upper side of the lock operator piston to the tubular pressure (see FIG. 4).

The lock operator piston 14 may be an actuator for actuating a tubular, tool, or other component within a downhole assembly. During installation, it may be desirable to lock the lock operator piston 14 in place (axially) and thus avoid inadvertent actuation. For this reason, the hydraulic lock 10 of the present disclosure may be employed. In some embodiments, the lock operator piston 14 may be used to lock a latch a further component of the downhole string.

The lock operator piston 14 is located in an annulus in the tubular body 12. The lock operator piston 14 comprises a piston body 14*a* and outer and inner seals 14*b*, 14*c*.

The tubular body annulus also defines part of the hydraulic chamber 18.

The fluid release valve 16 comprises a valve chamber 20 that, in the present example, is defined by a cylindrical bore within the tubular body 12. The valve chamber 20 is axially aligned with the tubular.

The lock operator piston 14 is sealed with respect to the annulus in which it is located (e.g. the outer and inner circumferential surfaces of the tubular housing). As such, fluid is prevented from leaving the hydraulic chamber via the lock operator piston 14. The lock operator piston 14 defines a first seal area. A differential pressure across the lock operator piston 14 acts on the first seal area. In the specific example of FIG. 1, a first side of the lock operator piston 14 is exposed to the internal pressure of the tubular or tool—e.g. the pressure within the internal bore of the tubular. As such, in the present example and as shown in the configuration of FIG. 1, the differential pressure across the lock operator piston 14 (which acts over the first seal area) is defined by the internal tubular pressure and the hydraulic cavity 18 pressure.

The fluid release valve 16 comprises a valve port 22 that is open to the annulus (e.g. the bore annulus surrounding the tubular). The fluid release valve 16 further comprises a valve member 24, in the form of a valve member rod in the present example. In the hydraulic lock 10 of FIG. 1, the valve member 24 is axially aligned within the valve chamber 20 and is axially moveable within the valve chamber 20.

The fluid release valve 16 is configured to move from a sealing arrangement, in which fluid in the hydraulic chamber 18 is unable to communicate with the annulus via the valve port 22; to an open arrangement, in which fluid in the hydraulic chamber 18 can communicate with the annulus via the valve port 22. The valve member 24 is configured to move axially within the valve chamber 20 under the action of a differential pressure. The fluid release valve 16 is configured to move from the sealing arrangement to the open arrangement responsive to the valve member 24 moving axially within the valve chamber 20.

In this specific hydraulic lock 10, and in the configuration shown in FIG. 1, the differential pressure acting on the valve member 24 is defined by the annulus pressure and the hydraulic chamber 18 pressure. The fluid release valve 16 defines a second seal area over which the differential pressure within the fluid release valve 16 acts.

The first seal area of the lock operator piston 14 is larger (e.g. significantly larger) than the second seal area of the fluid release valve 16. This is because the first seal area is defined over an annulus of the tubular body 12, whereas the second seal area is defined within a single axial bore located within the radius of the tubular body 12. As both the first seal area and second seal area are operatively connected to the hydraulic chamber 18, and the volume of the hydraulic chamber will not change during use, a small axial movement of the lock operating piston 14 (with its larger first seal area) results in a much greater axial movement within the fluid release valve 16 (e.g. of the valve member 24).

Figure 2A:
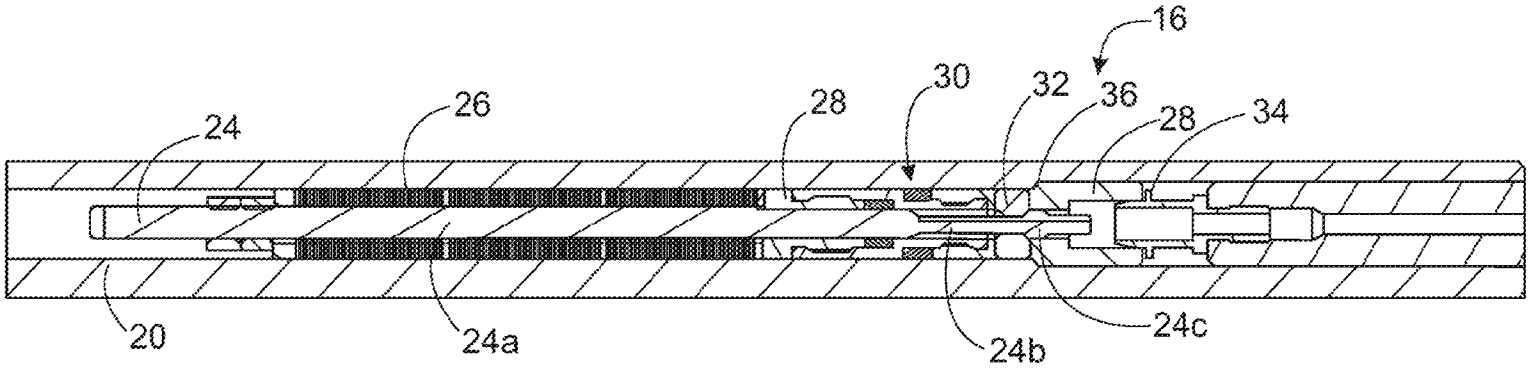
FIGS. 2A to 2C are time-sequential cross-section views of a fluid release valve of the hydraulic lock of FIG. 1.
Figure 2B:
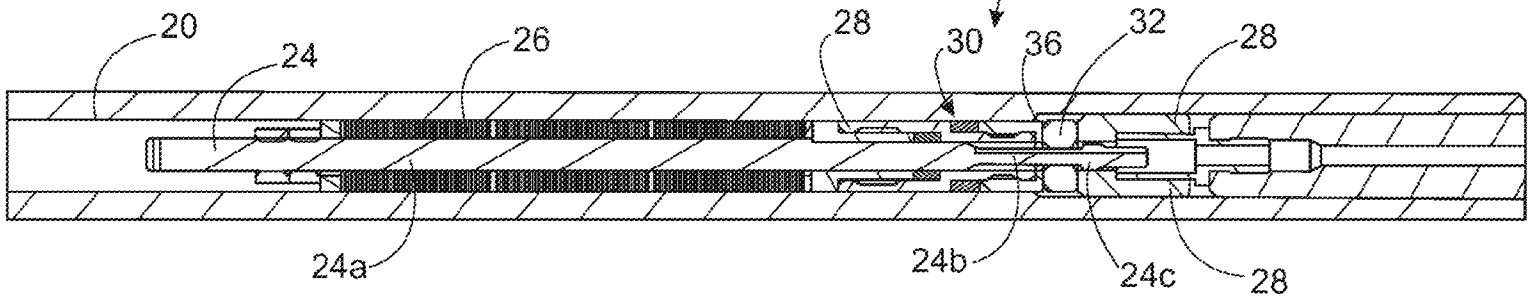
Figure 2C:
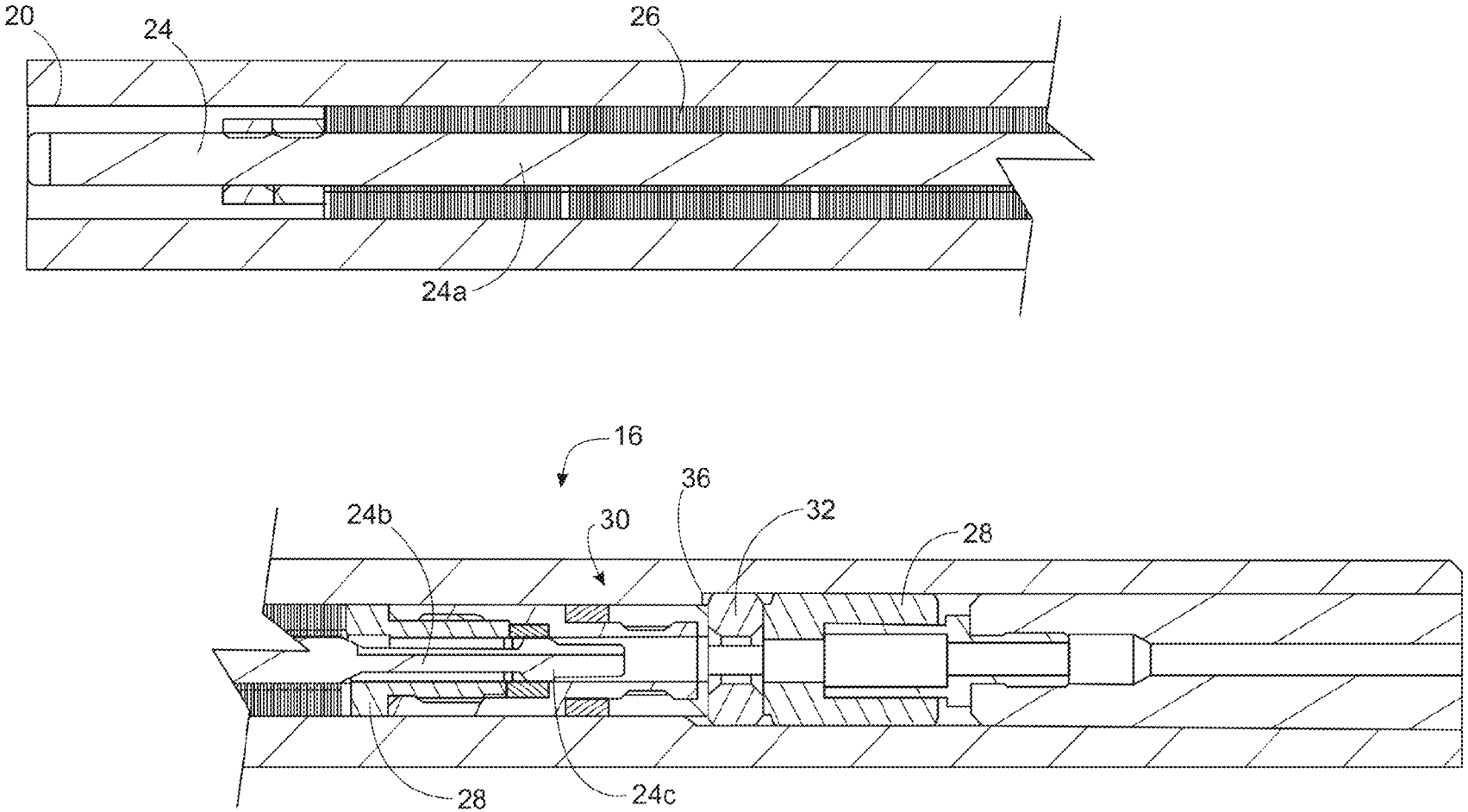

Turning now to FIGS. 2A to 2C, FIG. 2A shows the fluid release valve 16 in the sealing arrangement, FIG. 2C shows the fluid release valve 16 in the open arrangement and FIG. 2B shows the fluid release valve 16 in a transitional arrangement.

The fluid release valve 16 comprises a valve member 24 that extends along the axis of the fluid chamber 20. In the present example, the valve member 24 comprises a cylindrical section 24*a* of a first diameter, a neck section 24*b* of a reduced diameter a head section 24*c* with a diameter that is larger than that of the neck section 24*b*. As such, the neck section 24*b* provides a reduced-diameter section compared to the sections 24*a*, 24*b* on either side.

A part of the cylindrical section 24*a* of the valve member 24*a* is surrounded by a spring 26. The spring 26 of this example is axially retrained at one end with respect to the valve member 24, and at its other end with respect to a carriage assembly 28.

The carriage assembly 28 is generally annular and defines a flow path therethrough. The carriage assembly 28 comprises a number of subcomponents, including a sealing assembly 30. The sealing assembly 30 is arranged to cooperate with the valve member 24 (and in particular the cylindrical section 24*a* thereof) to seal the fluid release valve 16 and prevent fluid flow therethrough when the fluid release valve 16 is in a sealing arrangement.

The carriage assembly 28 also houses multiple keys 32. The keys 32 are axially restrained with respect to the carriage assembly 28. Each key 32 comprises a block that is housed in a cut-out in the carriage assembly 28. Each key comprises chamfered edges to act as cam surfaces with respect to adjacent components.

In the sealing arrangement, as shown in FIG. 2A, the keys 32 are located adjacent the neck section 24*b* of the valve member 24, abutting the head 24*c*. As such, the keys 32 act to axially-retrain the valve member 24 with respect to the carriage assembly 28.

The carriage assembly 28 is axially retrained by a shear ring 34, which in the present example is axially fixed with respect to the tubular housing 12.

In order to unlock the hydraulic lock 10, and thus free the lock operator piston 14 for axial movement, an operator needs to move the fluid release valve 16 from the sealing arrangement (in which the hydraulic chamber 18 is isolated) to the open arrangement (in which the hydraulic chamber 18 is in fluidic communication with the annulus).

FIG. 2A shows the fluid release valve 16 in the sealing arrangement. The sealing assembly 30 cooperates with the valve member 24 to seal the fluid chamber 20 and prevent fluid flow therethrough. The sealing assembly 30, valve member 24 and fluid chamber 20 cooperate to define the second seal area.

The spring 26 biases the carriage assembly 28 in a first direction (i.e. to the right of FIG. 2A) and the valve member 24 in a second direction opposition to the first direction; however, the keys 32 restrict axial movement of the valve member 24 with respect to the carriage assembly 28. As such, the fluid release valve is sealed, isolating the hydraulic chamber 18.

If a user increases the pressure in the tubular, the lock operator piston 14 is urged towards the hydraulic chamber which, in turn, urges the valve member 24 and carriage assembly 28 towards the shear ring 34. Once the differential pressure across the lock operator piston 14 reaches a threshold value, the shear ring 34 shears out, freeing the carriage assembly 28 to move axially under the action of the hydraulic chamber 18. As such, the carriage assembly 28 and valve member 24 move axially under the action of the pressure differential between the hydraulic chamber 18 and the annulus (as shown in FIG. 2B).

The valve chamber 20 defines a shoulder 36 on its inner circumferential wall. The shoulder 36 defines a reduction in the inner diameter of the valve chamber 20. The shoulder 36 is arranged such that, when the fluid release valve 16 is in a sealing arrangement, the keys 32 are adjacent the shoulder 36, in the portion of the valve chamber 20 with the smaller inner diameter.

As the carriage assembly 28 and valve member 24 move axially under the action of the pressure differential between the annulus and the hydraulic chamber 18, the keys 32 traverse the shoulder 36 and thus enter a region of the valve chamber 20 with a larger diameter. This allows the keys 32 to move radially. As the keys 32 are free to move radially, they are urged outward through interaction with the axially-urged valve member 24.

The valve member 24 is urged away from the carriage assembly 28 by the spring 26. When in this configuration, fluid is able to bypass the sealing assembly 30 via the neck 24*b* and head 24*c* portion of the valve member 24. As such, the hydraulic chamber 18 is no longer isolated from the valve port 22 (and thus annulus). This open arrangement is shown in FIG. 2C.

As an illustrative example, taking the first seal area of the lock operator piston 14 to be 5 $in^2$ (3225.8 $mm^2$), the second seal area of the fluid release valve 16 to be 0.02 $in^2$ (12.9 $mm^2$) and the distance of travel required of the valve member 24 and carriage assembly 28 to move from the sealing arrangement of FIG. 2A to the intermediate position shown in FIG. 2B (which allows the opening of the fluid release valve) to be 3 mm, the lock operator piston 14 is only required to move 0.012 mm in order to move the fluid release valve from the sealing arrangement to the open arrangement. This is beneficial, as the less movement required of the lock operator piston 14, the less chance there is for the piston to become worn or damaged by debris, for example.

Figure 3:
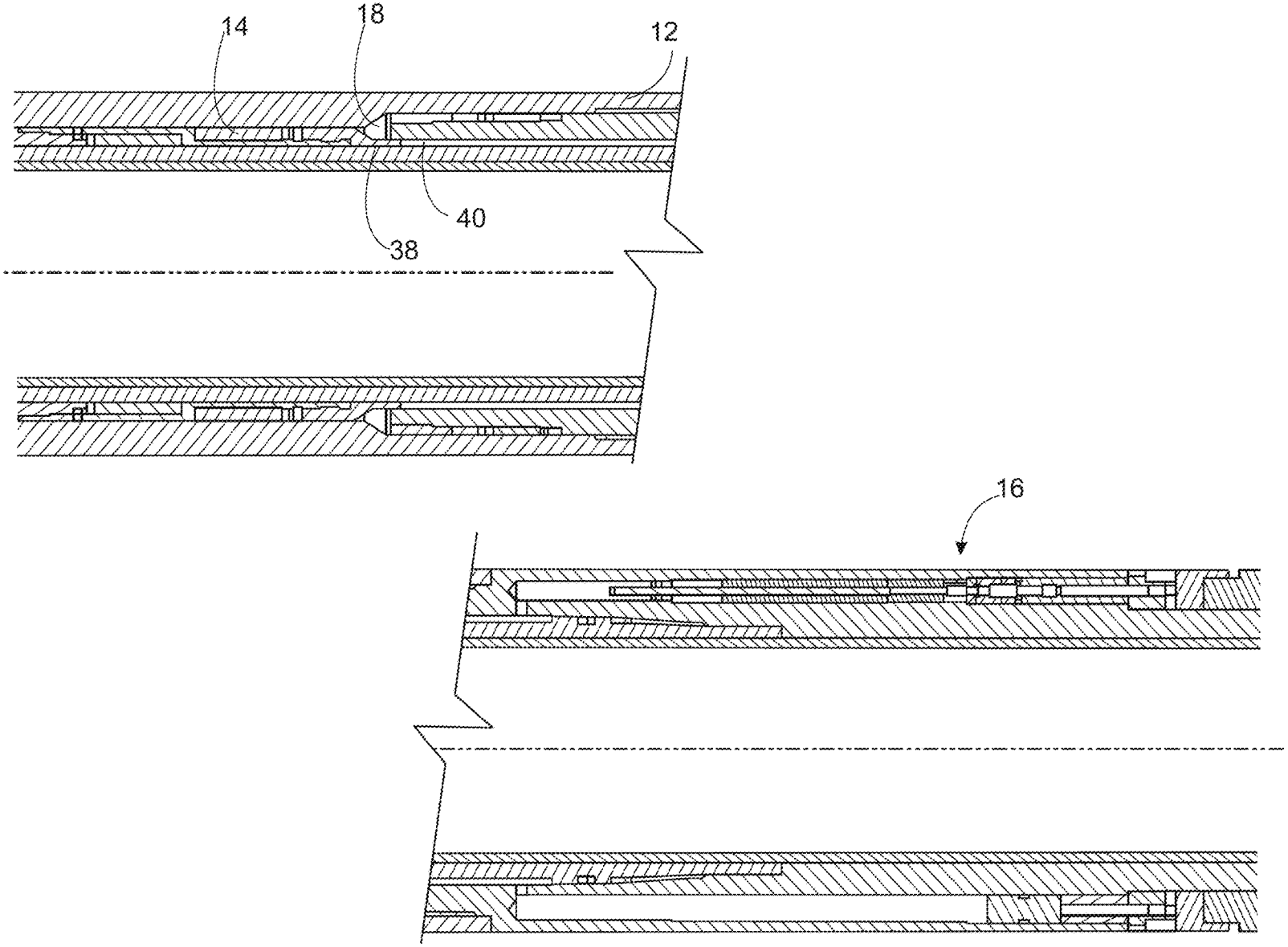
FIG. 3 is a further cross-section view of the hydraulic lock of FIG. 1.

FIG. 3 shows the hydraulic lock 10 in a specific arrangement. In the arrangement shown in FIG. 3, the fluid release valve is in an open arrangement, such that the hydraulic chamber 18 is open to annulus pressure. As such, the pressure differential acting across the lock operator piston 14 is defined by the tubular internal pressure (acting from the left of FIG. 3) and the annulus pressure (acting from the right of FIG. 3).

In the arrangement shown in FIG. 3, the pressure differential across the lock operator piston 14 is such that the lock operator piston 14 has been urged downhole (to the right of FIG. 3). The downhole side of the lock operator piston 14—that is, the side of the lock operator piston 14 adjacent the hydraulic chamber 18—defines a reduced cross-section. In the present example this is in the form of a 'nose' portion 38.

The nose portion 38 of the lock operator piston 14 is arranged to engage a restriction defined by the hydraulic chamber 18. Once engaged, the nose portion 38 provides an interference fit with the restriction 40 of the hydraulic chamber 18. Given the geometry of the nose portion 38 and restriction 40, the seal area for the annulus pressure (e.g. the surface area over which the annulus pressure can act) is now significantly less than the seal area over which the tubular pressure can act. As such, in order to urge the lock operator piston 14 in an up-hole direction (i.e. to the left of FIG. 3 and away from the fluid release valve 16), the annulus pressure must be significantly higher than the tubular pressure.

Furthermore, the interference fit is achieved by a pressure acting on a comparatively large area (the first seal area). Given this high force and relatively small area of interaction between the nose portion 38 of the lock operator piston 14 and the inlet of the piston chamber, a high degree of interference fit may be achieved, thus required a large force to dislodge the lock operator piston 14.

FIG. 4 shows an uphole end of the lock operator piston 14. As can be seen, the lock operator piston 14 can engage a further component, e.g. tool or tubular, such as a mandrel 44. In the present example this connection is facilitated by a series of sleeves 43*a-c*, including a key housing 43*c*. The key housing 43*c* houses a plurality of keys 47 that protrude from the inner radial surface and engage a flange on the mandrel 44. Each key 47 is held in place by a shear screw 42.

FIGS. 5A to 5G show a further example of a fluid release valve 116. The fluid release valve 116 of FIGS. 5A to 5G comprises a valve member rod 124, spring 126, carriage assembly 128, sealing assembly 130 and keys 132 as in the previous example. Limited description will be provided regarding these features as they largely correspond to those of the previous example.

The example of FIGS. 5A to 5G comprises a ratchet module 150. The ratchet module 150 may be part of the valve member. The valve member also comprises the valve member rod 124. The ratchet module 150 comprises a double ratchet. A first ratchet engages the valve member rod 124 and only allows the ratchet module 150 to move in a second direction (to the left of FIG. 5A) with respect to the valve member rod 124. A second ratchet engages the carriage assembly 126 and only allows the ratchet module 150 to move in the second direction with respect to the carriage assembly 126.

Figure 5A:
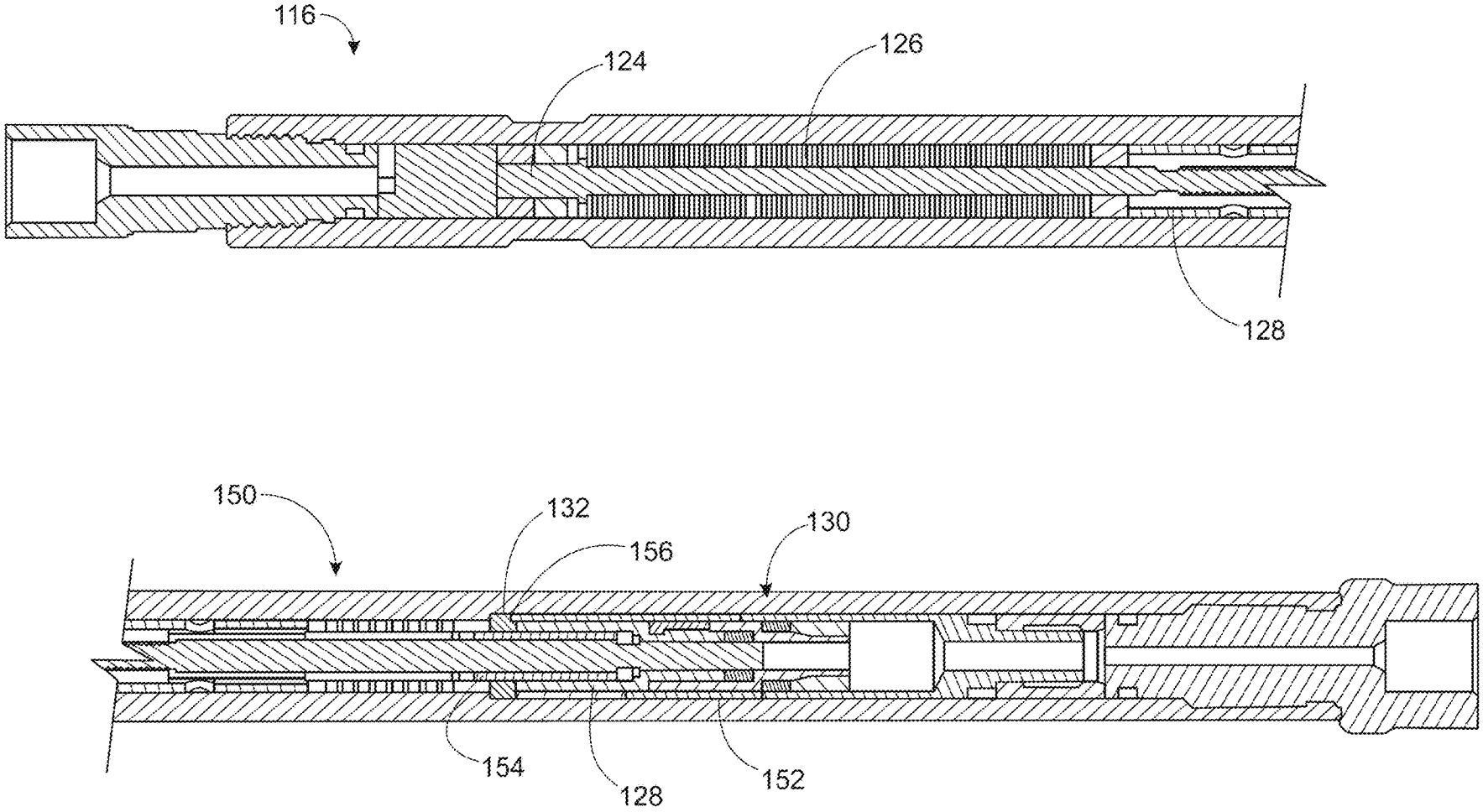
FIGS. 5A to 5G are time-sequential cross-section views of a second fluid release valve.
Figure 5B:
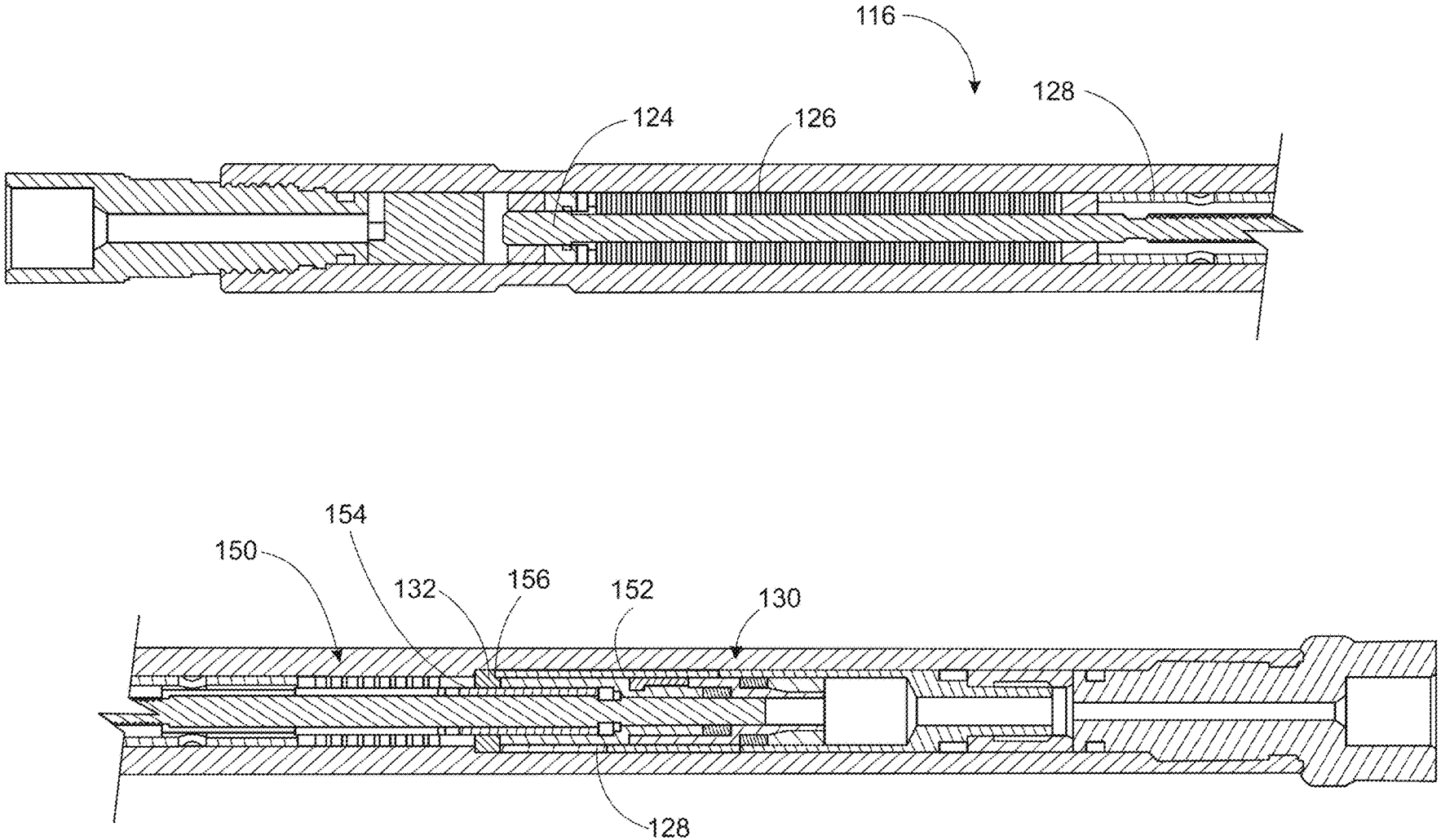
Figure 5C:
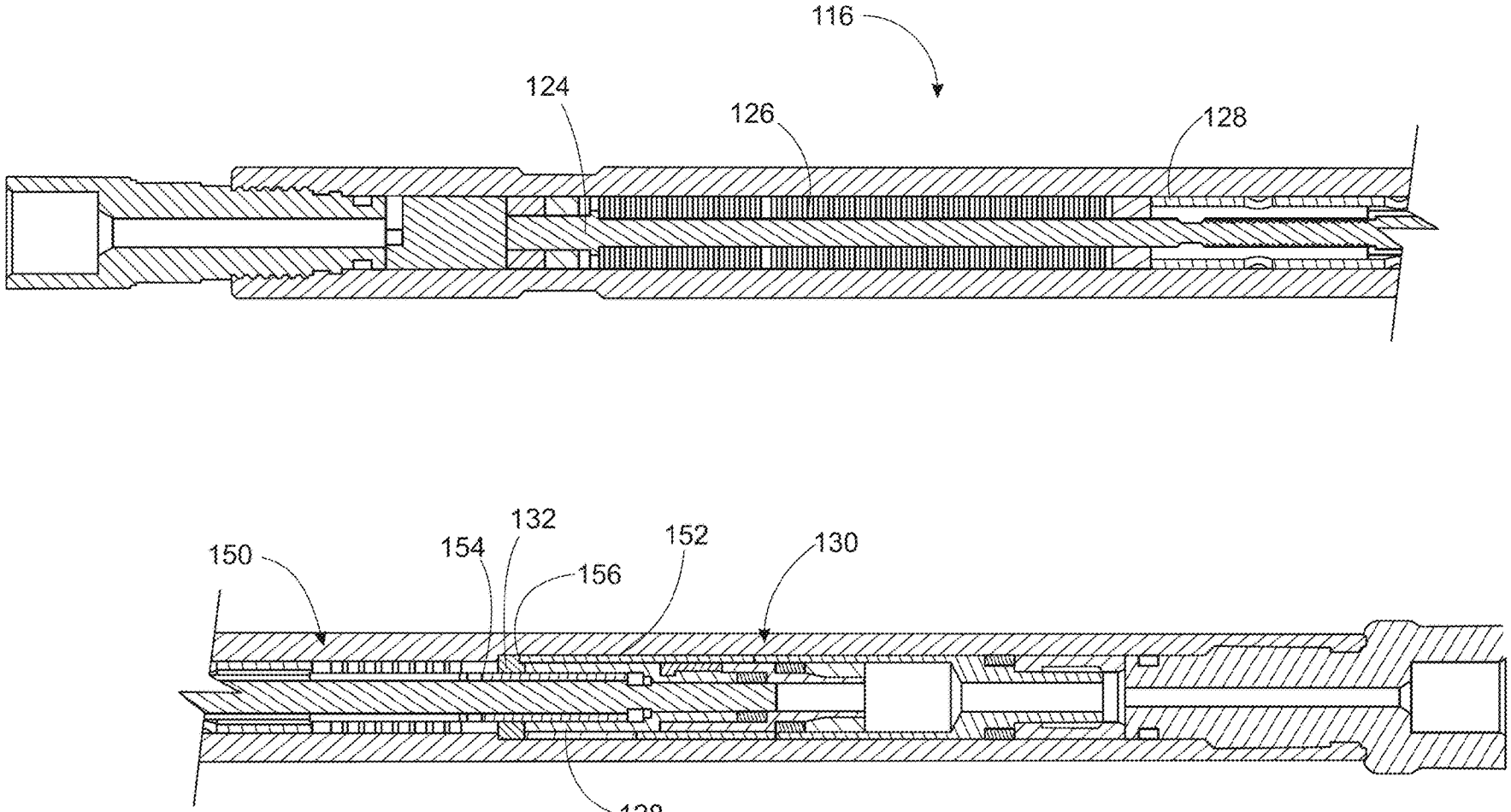
Figure 5D:
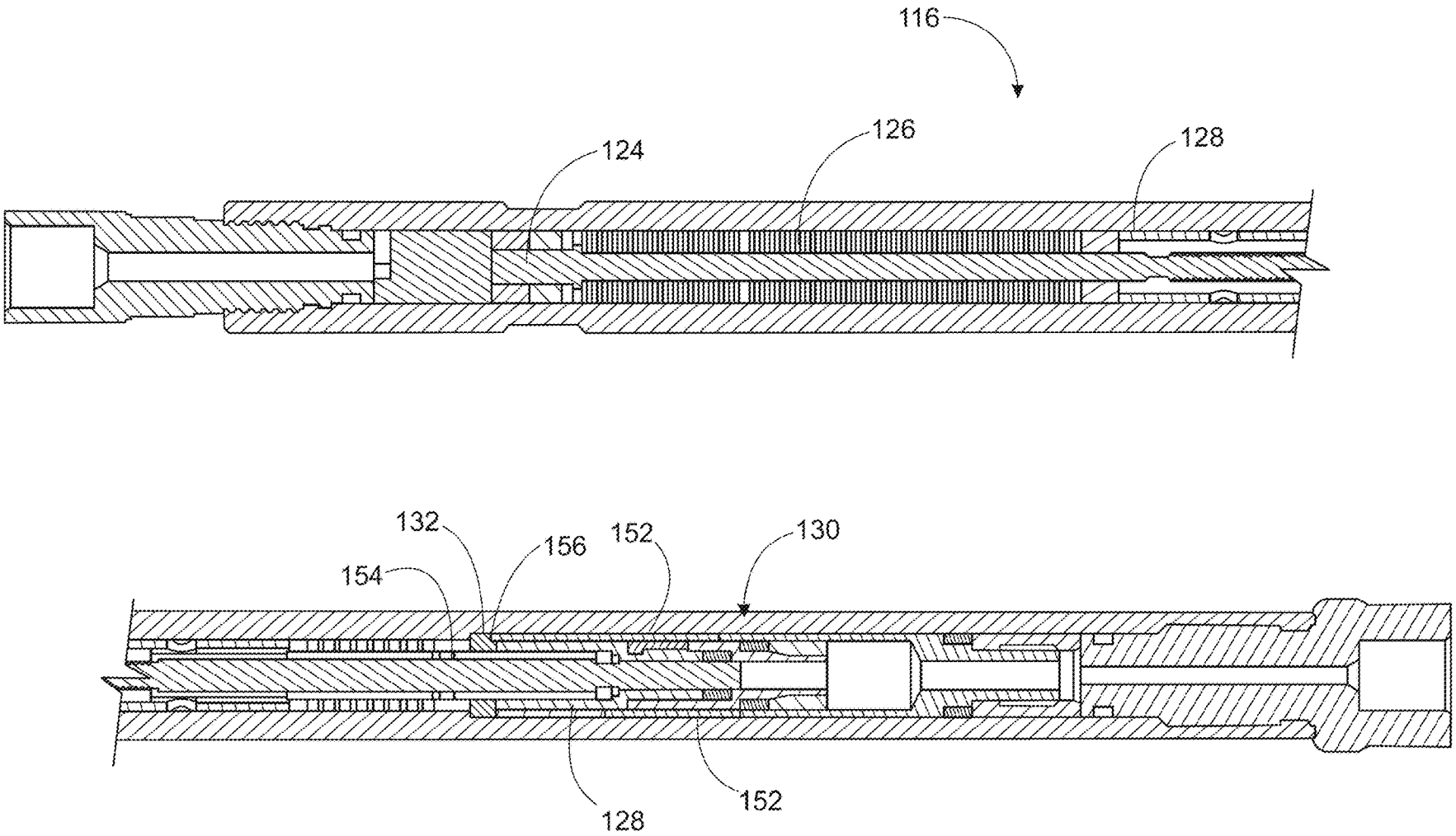
Figure 5E:
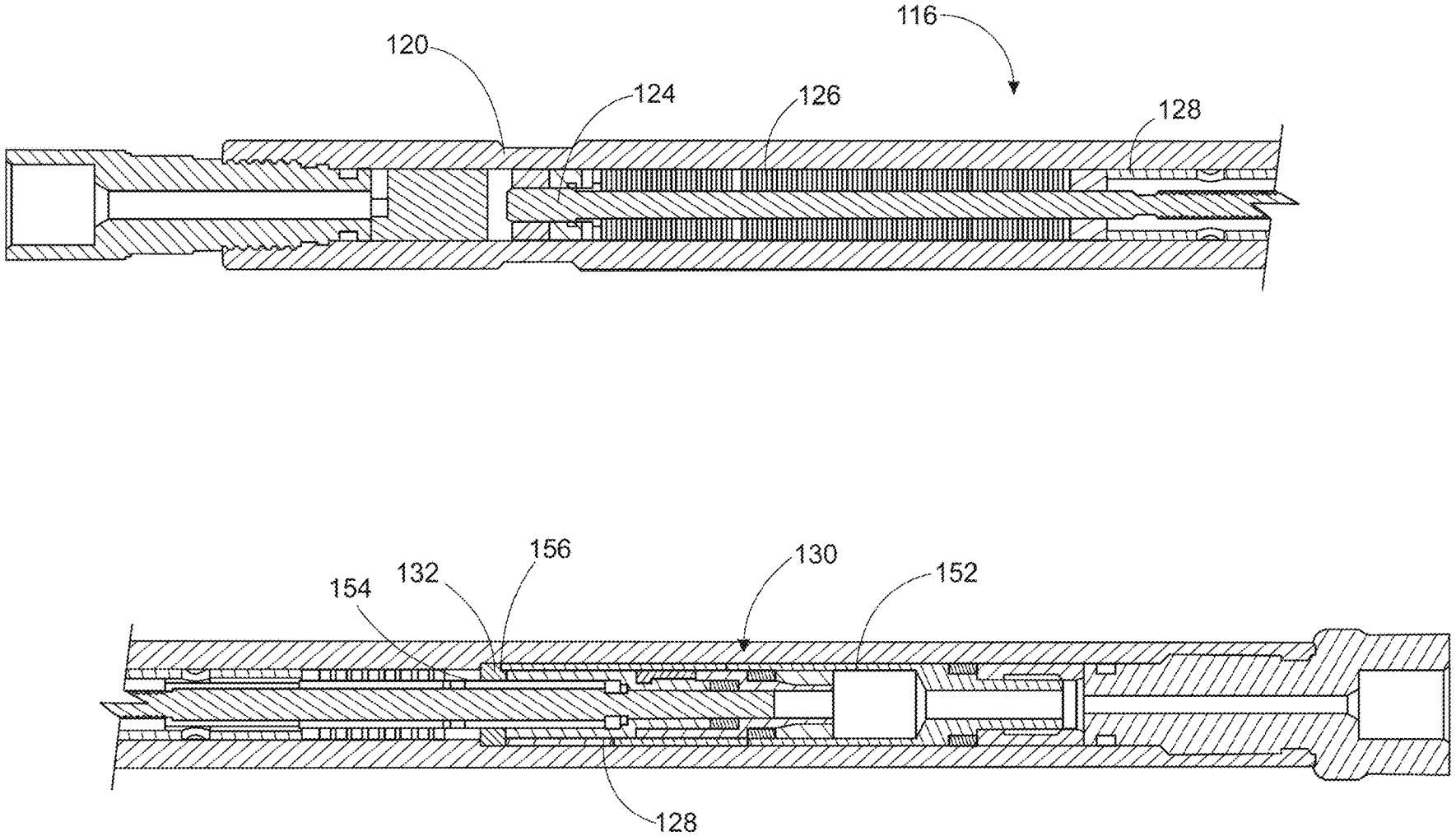

In the example of FIGS. 5A to 5G, the outer circumference of the keys 132 engage a shoulder 156 on the inside surface of the valve chamber 120, preventing axial movement of the keys 132 (and hence carriage assembly 128) relative to the valve chamber 120. The keys 132 are biased inwardly, and so wants to reduce in radius, but is prevented from doing so by a blocking member 154. The ratchet module 150 comprises the blocking member 154 which, in the arrangement shown in FIG. 5A, is arranged concentrically inside of the keys 132.

As a user increases the pressure within the tubular, the valve member rod 124 is urged in a first direction (to the right of FIG. 5A), as was the case in the above example. This causes the first ratchet to progress with respect to the valve member rod 124. When the pressure in the tubular is reduced, the spring 126 urges the valve member rod 124 in the second direction (to the left of FIG. 5A), which brings the ratchet module 150 with it, thus progressing the second ratchet with respect to the carriage assembly 128. Further cycles of pressure within the tubular incrementally move the ratchet module 150 in the second direction (i.e. to the left of FIG. 5A) which, in turn, gradually withdraws the blocking member 154 from within the keys 132. This process is shown in FIGS. 5A to 5E.

Figure 5F:
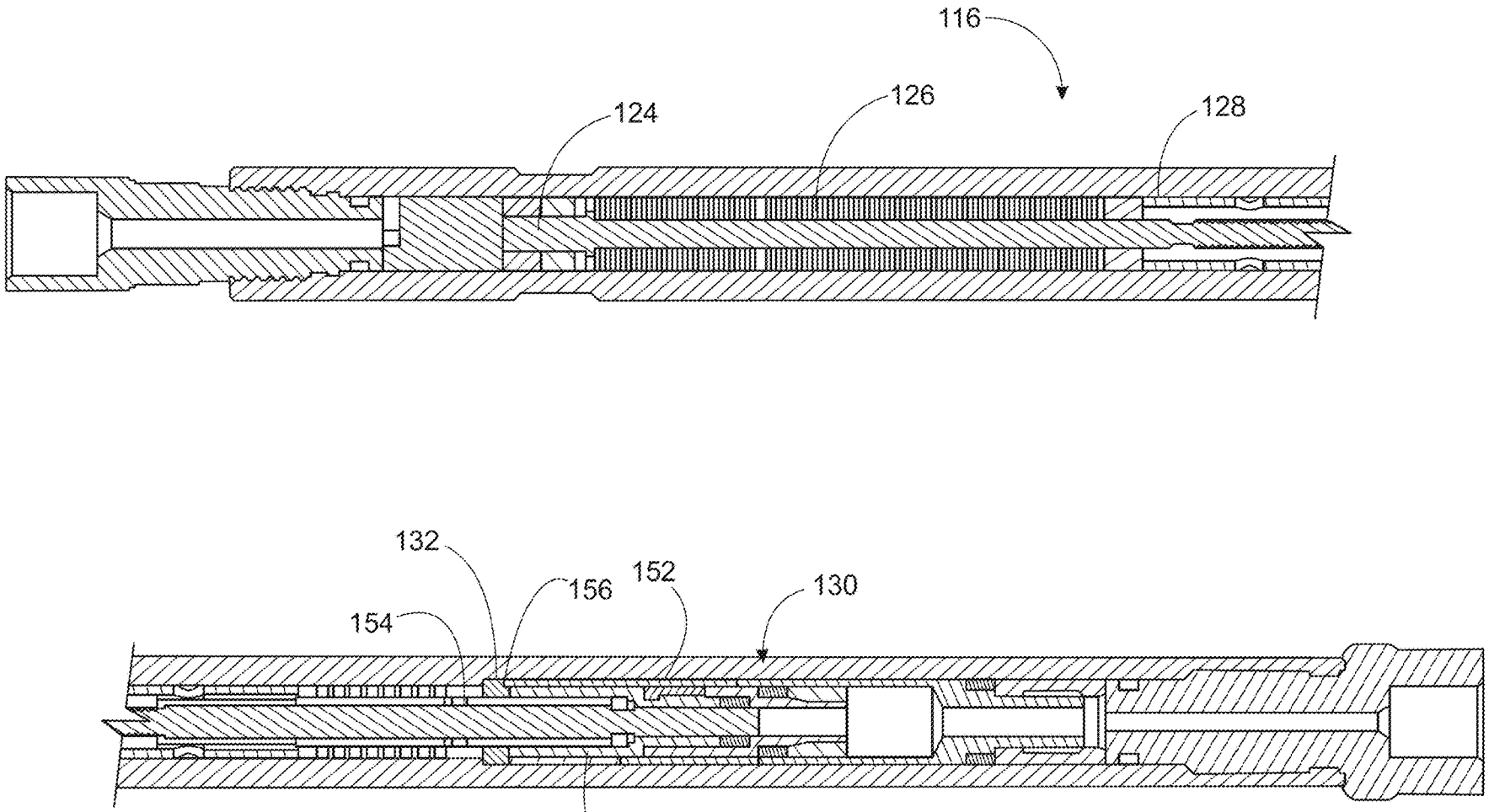
Figure 5G:
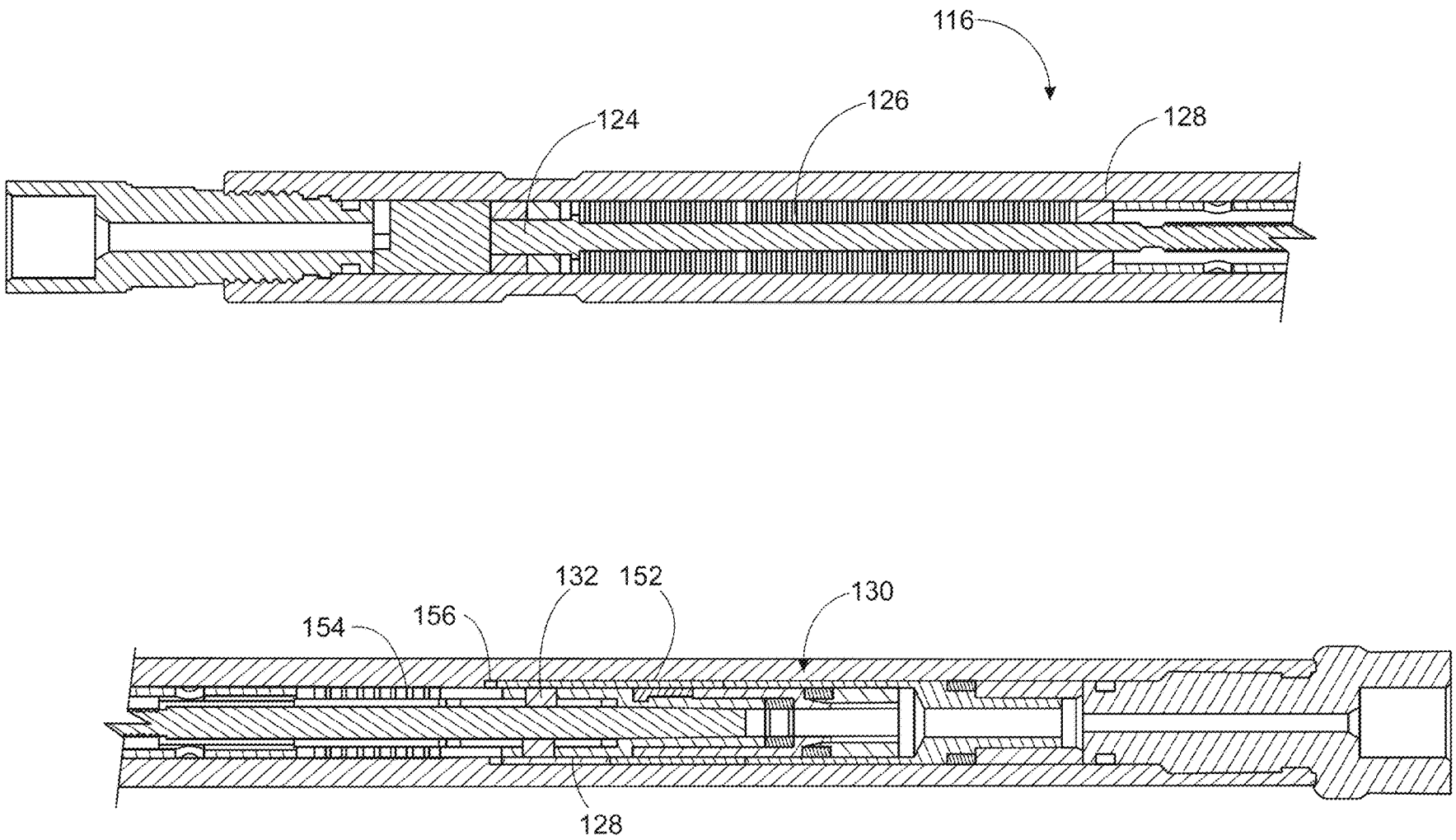

In FIG. 5F, the blocking member 154 is completely withdrawn from blocking the keys 132 and the keys 132 are free to move radially. As such, the keys no longer prevent axial movement of the carriage assembly 128. The carriage assembly 128 is free to move axially within the valve chamber 120. The carriage assembly 128 is then urged in the first direction by the spring 126, as shown in FIG. 5G, opening the fluid release valve 116.

Figure 6A:
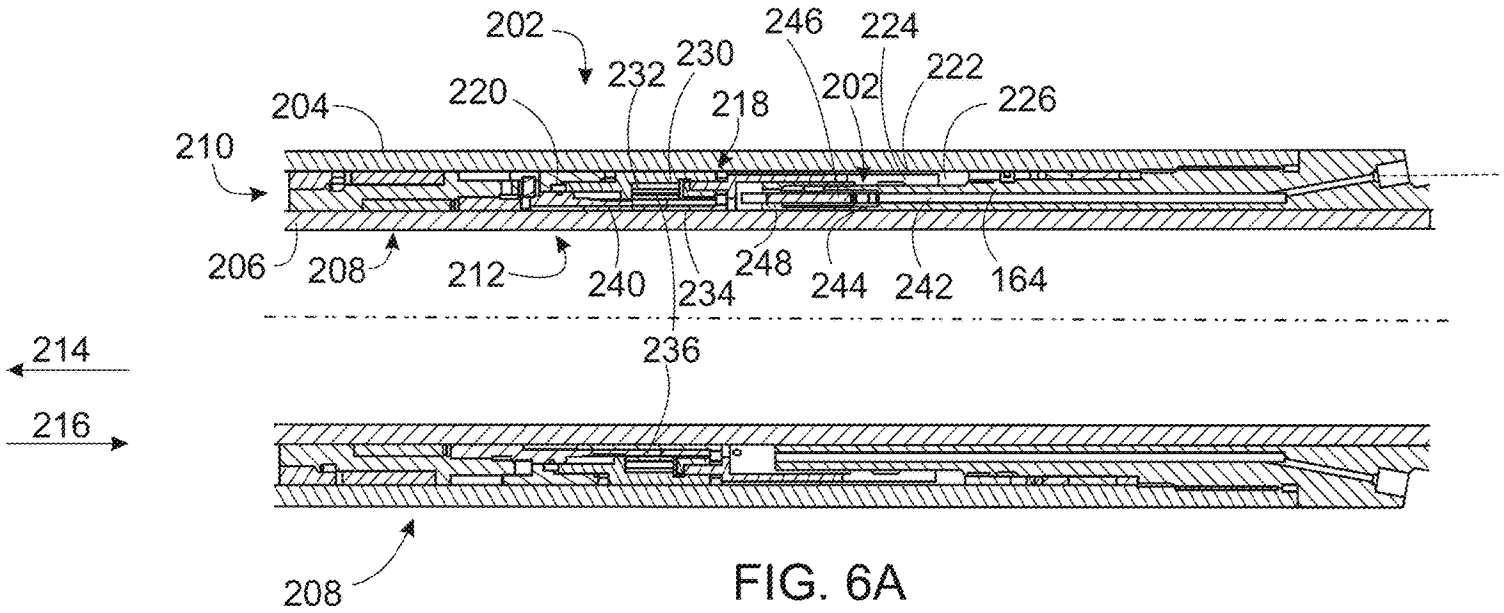
FIGS. 6A to 6C are time-sequential cross-section views of an actuator for use with the present disclosure.
Figure 6B:
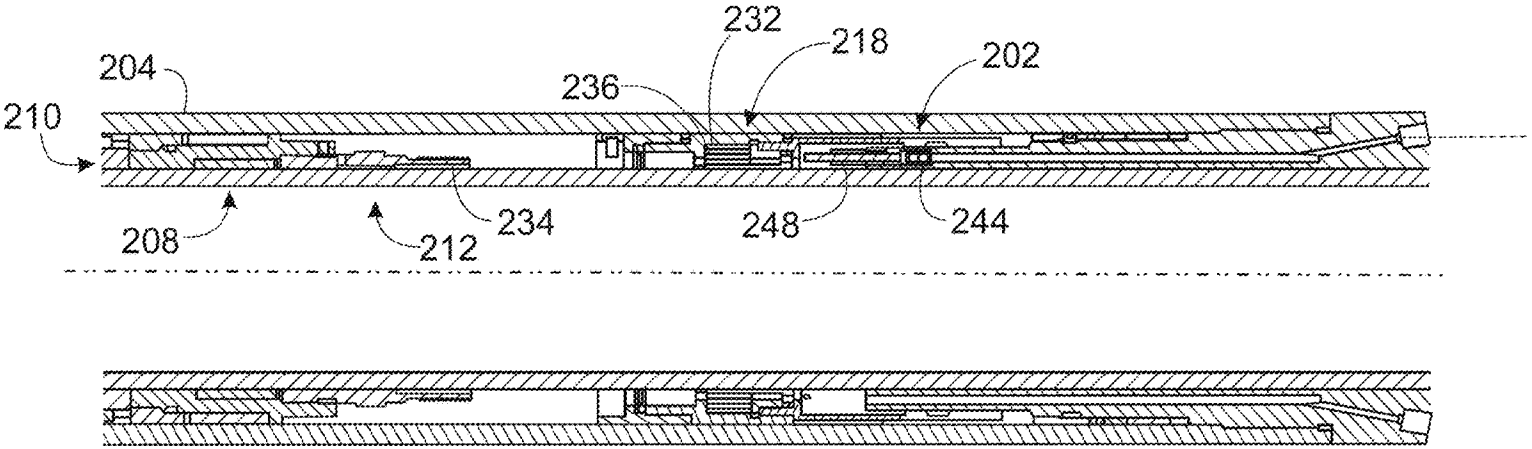
Figure 6C:
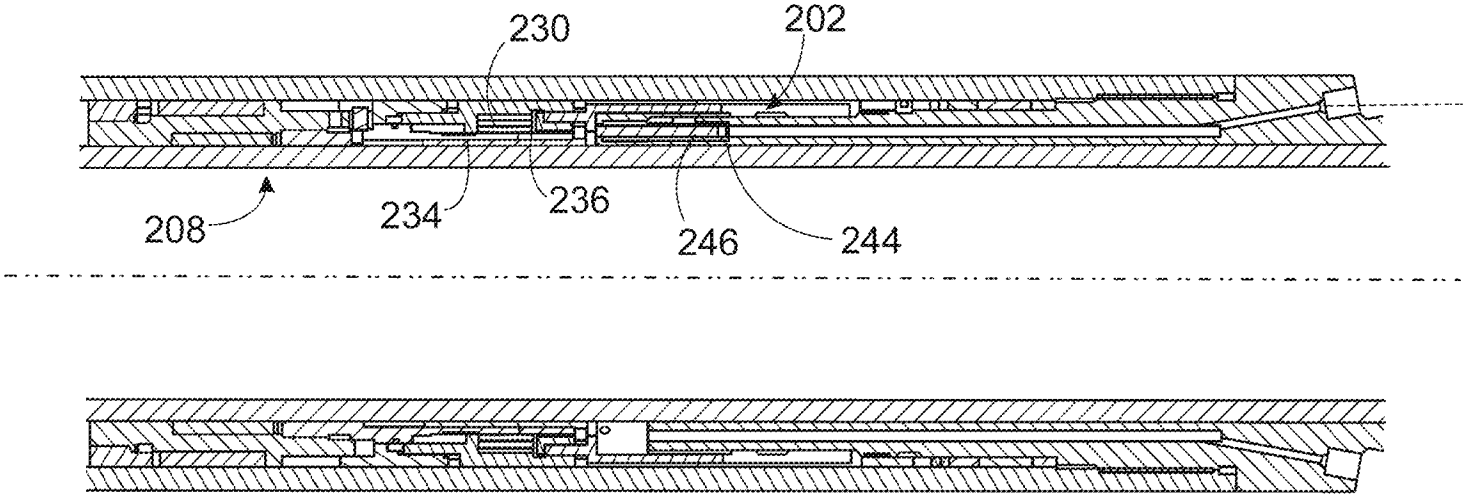

FIGS. 6A to 6C show an actuator 200. The actuator 200 of FIGS. 6A to 6C provide a further example of a piston arranged to engage an inlet as described herein.

The actuator 200 is mounted in an annular space 202 between a housing 204 (e.g. a tubular housing) and a seat sleeve 206. The actuator 200 includes an annular piston assembly 208. In use, a first side 210 of a piston assembly 208 is exposed to tubing pressure, whereas a second side 212 is exposed to annulus pressure. As such, the annular piston assembly 208 may be moveable in response to any pressure differential applied. Specifically, where the annulus pressure dominates (referred to as an annulus/tubing pressure differential) the piston assembly 208 will be biased in the first axial direction 214, and when the tubing pressure dominates (referred to as a tubing/annulus pressure differential) the piston assembly 208 will be biased in the second axial direction 216.

The actuator 200 further includes a ratchet module 218 which is initially axially secured to the piston assembly 208 via a shear ring 220. The ratchet module 218 includes a lower ratchet box or sleeve 222 which includes a ratchet profile 224 on an inner surface thereof, and is in engagement with a corresponding ratchet profile 226 on an inner sleeve 228 which is secured to the housing 204. The ratchet profiles 224, 226 are arranged such that the ratchet module 218 may move relative to the housing 204 in the second direction 216, but is prevented from movement in the first direction 214.

The ratchet module 218 further includes an upper ratchet box 230 in the form of an axially captivated split ring which includes a ratchet profile 232 on an inner surface thereof. The piston assembly 208 includes a ratchet pin or nose 234 which includes a ratchet profile 240 on an outer surface thereof, and in the illustrated initial configuration extends axially into the upper ratchet box 230. However, the ratchet module 218 further includes a split ring spacer 236 which is initially radially interposed between the upper ratchet box 230 and the ratchet pin 234 of the piston assembly 208, thus preventing any engagement of the respective ratchet profiles 232, 240.

An annulus pressure delivery bore 242 extends axially through the inner housing sleeve 228. The delivery bore 242 opens into the annular space 202 and includes a plug seat 244 at its open end. The actuator 200 further includes a plug plunger 246 which is initially separated from the plug seat 244 in the illustrated initial configuration. The plug plunger 246 includes a shear assembly 248 which initially provides separation between the plug 246 and plug seat 244.

During use, the piston assembly 208 of the actuator 200 is driven by an annulus/tubing differential pressure to move in the first direction 214. The differential pressure overcomes the force of the shear ring 220 and the piston assembly 208 moves to the position shown in FIG. 6B. The split ring spacer 236 moves radially inwards as the ratchet pin or nose 234 moves in away.

When the differential pressure across the piston assembly 208 changes such that the piston assembly 208 is urged in the second direction 216, the piston assembly 208 moves to the right as shown in FIG. 6C. The axial end face of the ratchet pin or nose 234 of the piston assembly 208 engages an end face of the split ring spacer 236, which has moved into the path of the piston assembly 208. As the piston assembly continues to move in the second direction, the ratchet profile 240 of the tubular assembly 208 engages the corresponding ratchet profile of the upper ratchet box 230. The axial end face of the ratchet pin or nose 234 urges the split ring spacer 236 in the second direction. The piston assembly 208 and split ring spacer 236 act to urge the plug plunger 246 to engage the plug seat 244. Once the plug plunger 246 engages the plug seat 244, the seal area over which annulus pressure acts is greatly reduced compared to the area over which tubing, or tubular, pressure acts. As such, in order to urge the piston assembly 208 in a first direction the annulus pressure must greatly exceed the tubing pressure.

It should be noted that the actuator 200 may be used independently in any other apparatus, and is not exclusively for use in the present described apparatus. In this respect, an aspect of the present disclosure relates to the first actuator for use in providing actuation to any other object or apparatus.

The present invention has been described above purely by way of example. Modifications in detail may be made to the present invention within the scope of the claims as appended hereto.

The invention claimed is:

1. A downhole hydraulic lock apparatus, comprising:

a lock operator piston arranged to be axially moveable in a piston chamber, the lock operator piston sealing the piston chamber to define a first seal area;

a fluid release valve comprising a valve port, a valve chamber a valve member, and a seal assembly axially moveable within the valve chamber, wherein the fluid release valve is reconfigurable from a sealing arrangement, in which the seal assembly seals between the valve chamber and the valve member, to an open arrangement, in which the seal assembly does not seal between the valve chamber and the valve member, and wherein the seal assembly defines a second seal area when in the sealing arrangement; and a hydraulic chamber extending between the piston chamber and the valve chamber such that the first seal area of the lock operator piston and the second seal area of the seal assembly are operatively associated with each other by said hydraulic chambers, wherein the first seal area defined by the lock operator piston in the piston chamber is larger than the second seal area defined by the valve member between the valve chamber and the valve members, and wherein the fluid seal assembly is moveable in the valve chamber by a first distance, from the sealing arrangement, in which the hydraulic chamber is isolated from the valve port by the seal assembly, to the open arrangement, in which the hydraulic chamber is in fluid communication with the valve port via the valve chamber, in response to a differential pressure cycle being applied to the seal assembly over the second seal area by movement of the lock operator piston in the piston chamber, the movement of the lock operator piston in the piston chamber being in a direction towards the hydraulic chamber and over a second distance, wherein the second distance is less than the first distance.

2. The apparatus of claim 1, wherein the lock operator piston is an annular piston.

3. The apparatus of claim 1, wherein the lock operator piston defines:

a first pressure surface corresponding to the first seal area which is arrangeable to be exposed to an operating pressure; and a second pressure surface which is arrangeable to be exposed to the hydraulic chamber.

4. The apparatus of claim 3, wherein the second pressure surface comprises a protrusion that defines an end surface with a smaller surface area than the first seal area.

5. The apparatus of claim 1, wherein the piston chamber comprises an inlet, the inlet defining an inlet area which is smaller than the first seal area.

6. The apparatus of claim 5, further comprising a plug arranged to mate with the inlet, wherein the lock operator piston is configured to urge the plug into engagement with the inlet such that the plug mates with the inlet, sealing the inlet, wherein the lock operator piston is urged by a pressure acting over the seal area.

7. The apparatus of claim 6, wherein the lock operator piston comprises the plug.

8. The apparatus of claim 1, wherein the valve chamber is cylindrical.

9. The apparatus of claim 1, wherein the valve member comprises a rod.

10. The apparatus of claim 1, wherein the fluid release valve comprises a key configured to cooperate with the valve member to hold the fluid release valve in the sealing arrangement.

11. The apparatus of claim 10, wherein the key is configured to move from a blocking position, in which the fluid release valve is held in the sealing arrangement, to a free position, in which the fluid release valve is free to move to the open arrangement.

12. The apparatus of claim 11, wherein the valve member is configured to move from a first position, in which the key is held in the blocking position, to a second position, in which the key is free to move to the free position, under an action of a pressure differential across the seal assembly.

13. The apparatus of claim 11, wherein the fluid release valve comprises a ratchet module configured to incrementally move from a first position, in which it holds the key in the blocking position, to a second position, in which the key is free to move to the free position, in response to a cyclic pressure differential acting across the seal assembly.

14. The apparatus of claim 13, wherein the ratchet module comprises a first ratchet configured to restrain movement of the ratchet module relative to a rod of the valve member and a second ratchet configured to restrain movement of the ratchet module relative to the key.

15. The apparatus of claim 1, configured to be arranged in a tubular housing of a tubular.

16. The apparatus of claim 15, wherein the lock operator piston is an annular piston arranged in the tubular housing and the valve chamber is an axially-aligned bore in the tubular housing.

17. The apparatus of claim 15, wherein the valve port is arranged on an outer surface of the tubular housing.

18. The apparatus of claim 15, wherein the lock operator piston is operatively connected to a tool component such that movement of the lock operator piston actuates the tool component.

19. A method for unlocking the hydraulic lock of the apparatus of claim 1, the method comprising:

axially moving the lock operator piston defining the first seal area by the second distance to cause axial movement of the seal assembly defining the second seal area by the first distance, thereby reconfiguring the fluid release valve from the sealing arrangement to the open arrangement.

* * * * *